US009321099B1

(12) United States Patent
Toh

(10) Patent No.: US 9,321,099 B1
(45) Date of Patent: Apr. 26, 2016

(54) ULTRASONIC RIVETING TOOL AND METHOD

(71) Applicant: The Boeing Company, Chicago, IL (US)

(72) Inventor: Chin H. Toh, Orange, CA (US)

(73) Assignee: The Boeing Company, Chicago, IL (US)

( * ) Notice: Subject to any disclaimer, the term of this patent is extended or adjusted under 35 U.S.C. 154(b) by 117 days.

(21) Appl. No.: 13/954,365

(22) Filed: Jul. 30, 2013

(51) Int. Cl.
*B21J 15/02* (2006.01)
*B21J 15/10* (2006.01)

(52) U.S. Cl.
CPC *B21J 15/02* (2013.01); *B21J 15/10* (2013.01); *Y10T 29/49943* (2015.01); *Y10T 29/49956* (2015.01)

(58) Field of Classification Search
CPC ..... Y10T 29/49956; Y10T 29/49943; B21J 15/02; B21J 15/10; B21J 15/08
See application file for complete search history.

(56) References Cited

U.S. PATENT DOCUMENTS

| | | | | |
|---|---|---|---|---|
| 4,828,052 | A | 5/1989 | Duran et al. | |
| 6,108,896 | A | 8/2000 | Gignac et al. | |
| 6,820,319 | B2 * | 11/2004 | Heck et al. | 29/524.1 |
| 2011/0126396 | A1 * | 6/2011 | Clarke | B21J 15/025 29/525.06 |

FOREIGN PATENT DOCUMENTS

| | | | |
|---|---|---|---|
| EP | 0 340 094 | A2 | 11/1989 |
| EP | 0 402 222 | A1 | 12/1990 |
| EP | 0 421 019 | A1 | 4/1991 |

OTHER PUBLICATIONS

Speed of sound—Wikipedia, the free encyclopedia [online] [retrieved Sep. 3, 2013]. Retrieved from the Internet: <URL: http://en.wikipedia.org/wiki/Speed_of_sound>.. (Jul. 30, 2013) 18 pages.
Wave Propagation Fundamental s—3 Ultrasonic Attenuation [online] [retrieved Sep. 3, 2013]. Retrieved from the Internet: <URL: http://www.public.iastate.edu/~e_m.350/wave%20prop3%2013.pdf>. (Undated) 14 pages.
Sound Waves I [online] [retrieved Sep. 3, 2013]. Retrieved from the Internet: <URL: http://www2.cose.isu.edu/~hackmart/soundwavesIengphys.pdf>. (Undated) 13 pages.
Ultrasound [online] [retrieved Sep. 3, 2013]. Retrieved from the Internet: <URL: http://courses.washington.edu/bioen508/Lecture6-US.pdf>. (Undated) 24 pages.

(Continued)

*Primary Examiner* — Jason L Vaughan
*Assistant Examiner* — Amanda Meneghini
(74) *Attorney, Agent, or Firm* — Alston & Bird LLP

(57) ABSTRACT

An ultrasonic riveting tool and an associated method for installing a rivet are provided. The ultrasonic riveting tool and the associated method rely upon acoustic energy to cause the rivet to be installed. In the context of a method, a rivet is inserted into a bore defined by one or more workpieces. The rivet extends from a head to an opposed tail. The method also includes placing a bucking bar in an operative position with respect to the tail of the rivet. The method further includes applying acoustic energy to the head of the rivet to cause interaction between the rivet and the bucking bar such that the tail of the rivet is deformed. In this regard, the method may drive the rivet through the bore in response to application of acoustic energy so as to force the tail of the rivet into operative contact with the bucking bar.

14 Claims, 3 Drawing Sheets

(56) References Cited

OTHER PUBLICATIONS

Ultrasonic/sonic driller/corer—Wikipedia, the free encyclopedia [online] [retrieved Sep. 3, 2013]. Retrieved from the Internet: <URL: http://en.wikipedia.org/wiki/Ultrasonic/sonic_driller/corer>. (Jan. 29, 2013) 3 pages.

Ultrasonic Welding—Wikipedia, the free encyclopedia [online] [retrieved Sep. 3, 2013]. Retrieved from the Internet: <URL: http://en.wikipedia.org/wiki/Ultrasonic_welding>. (Aug. 7, 2013) 7 pages.

Ultrasonic horn—Wikipedia, the free encyclopedia [online] [retrieved Jul. 29, 2013]. Retrieved from the Internet: <URL: http://en.wikipedia.org/wiki/Ultrasonic_horn>. (dated Jul. 29, 2013) 4 pages.

Ultrasonic Welding, (brochure) Technical Information PW-2, Emerson Industrial Automation (Apr. 2013), 2 pages.

* cited by examiner

ULTRASONIC RIVETING TOOL AND METHOD

TECHNOLOGICAL FIELD

An example embodiment of the present disclosure relates generally to a riveting tool and method and, more particularly, to a riveting tool and method that utilize acoustic energy in order to install a rivet.

BACKGROUND

Rivets are installed for a variety of purposes in order to join two or more workpieces. For example, rivets are commonly utilized in order to join various workpieces during the fabrication of a vehicle, such as an air vehicle, a marine vehicle, an automobile or the like. As another example, rivets are frequently utilized to join various workpieces during the construction of buildings, overpasses, bridges or other types of structures.

During installation, a rivet is generally placed in a bore has been defined through the workpieces to be joined. The rivet typically includes a shank that extends from a head on a first side of the workpieces to an opposed tail that is positioned within the bore or proximate a second side of the workpieces, opposite the first side. A bucking bar may also be positioned on the second side of the workpieces in alignment with the bore defined by the workpieces. In order to complete the installation of the rivet, the rivet may be driven through the bore, such as by a rivet gun that utilizes compressed air in order to apply an impact force to the head of the rivet. The impact force applied to the head of the rivet drives the rivet through the bore such that the tail of the rivet contacts the bucking bar and is deformed to form, for example, a rivet button. The resulting rivet therefore joins the workpieces, which are securely held between the head of the rivet and the rivet button defined by the deformed tail of the rivet.

Rivet guns that utilize compressed air to generate the impact force upon the head of the rivet are generally relatively loud as a result of the repeated escape of the compressed air from the rivet gun and the typical hammering noise of metallic parts. Additionally, a rivet gun that relies upon compressed air to supply the impact force to the head of the rivet may experience vibrations, thereby creating challenges for the operator from an ergonomic perspective. Additionally, the impact force that is generated as a result of the compressed air may sometimes be somewhat difficult to control which may, in turn, impact the installation of the rivets, particularly as differently sized rivets are installed that could benefit from the application of different amounts of impact force.

BRIEF SUMMARY

An ultrasonic riveting tool and an associated method for installing a rivet are provided in accordance with an example embodiment of the present disclosure. The ultrasonic riveting tool and the associated method rely upon acoustic energy to cause the rivet to be installed. As a result of the reliance upon the acoustic energy, the ultrasonic riveting tool and associated method may be quieter than a riveting tool that relies upon compressed air to generate the impact force required for rivet installation. Additionally, the ultrasonic riveting tool and associated method of an example embodiment may allow for an improved ergonomic experience for the operator by smoothing vibrations generated during the installation of the rivet. Further, reliance upon acoustic energy in order to create the impact force that causes a rivet to be installed permits the impact force to be accurately controlled, thereby allowing for improvement or optimization in regards to the impact forces delivered during rivet installation, such as during the installation of rivets having various sizes.

In one embodiment, a method for installing a rivet is provided that includes inserting a rivet into a bore defined by one or more workpieces. The rivet extends from a head to an opposed tail. The method also includes placing a bucking bar in an operative position with respect to the tail of the rivet. The method further includes applying acoustic energy to the head of the rivet to cause interaction between the rivet and the bucking bar such that the tail of the rivet is deformed. For example, the method may also include driving the rivet further through the bore in response to application of acoustic energy so as to force the tail of the rivet into operative contact with the bucking bar.

The method may also include generating the acoustic energy and delivering the acoustic energy to the head of the rivet. In this embodiment, the method may also include establishing an impact force to be delivered to the head of the rivet based upon a frequency of the acoustic energy. In one embodiment, the acoustic energy is generated with an ultrasonic transducer that is spaced from the head of the rivet. In this embodiment, the method may also establish an impact force to be delivered to the head of the rivet based upon the distance between the ultrasonic transducer and the head of the rivet. The method may also include amplifying the acoustic energy following generation of the acoustic energy and prior to delivery of the acoustic energy to the head of the rivet.

In another embodiment, an ultrasonic riveting tool is provided that includes an ultrasonic transducer configured to generate acoustic energy and an acoustic anvil proximate a head of a rivet. The acoustic anvil is configured to receive the acoustic energy from the ultrasonic transducer and to deliver the acoustic energy to the head of the rivet so as to cause interaction between the rivet and a bucking bar, located in an operative position with respect to a tail of the rivet, such that the tail of the rivet is deformed.

The ultrasonic transducer may be configured to selectively provide acoustic energy having any one of a plurality of different frequencies such that an impact force to be delivered to the head of the rivet is configurable based upon the frequency of the acoustic energy. The ultrasonic riveting tool of one embodiment may also include a tool body positioned between the ultrasonic transducer and the acoustic anvil. The tool body may include a horn that is configured to direct the acoustic energy generated by the ultrasonic transducer to the acoustic anvil. The tool body of this embodiment contributes to the spacing of the ultrasonic transducer from the head of the rivet. As such, the impact force to be delivered to the head of the rivet is configurable based upon the spacing between the ultrasonic transducer and the head of the rivet. In one embodiment, the tool body may include a booster configured to amplify the acoustic energy.

In a further embodiment, an ultrasonic riveting system is provided that includes a bucking bar configured to be placed in an operative position with respect to a tail of a rivet that extends through a bore defined by one or more workpieces. The ultrasonic riveting system also includes an ultrasonic transducer configured to generate acoustic energy and an acoustic anvil proximate a head of the rivet. The acoustic anvil is configured to receive the acoustic energy from the ultrasonic transducer and to deliver the acoustic energy to the head of the rivet.

The ultrasonic transducer of one embodiment is configured to selectively provide acoustic energy having any one of a plurality of different frequencies such that an impact force to be delivered to the head of the rivet is configurable based upon the frequency of the acoustic energy. The ultrasonic riveting system of one embodiment also includes a tool body positioned between the ultrasonic transducer and the acoustic anvil. The tool body may include a horn that is configured to direct the acoustic energy generated by the ultrasonic transducer to the acoustic anvil and, in one embodiment, the tool body may also include a booster to amplify the acoustic energy. The tool body contributes to spacing the ultrasonic transducer from the head of the rivet. Thus, an impact force to be delivered to the head of the rivet may be configurable based upon the spacing between the ultrasonic transducer and the head of the rivet.

BRIEF DESCRIPTION OF THE DRAWINGS

Figure 1:
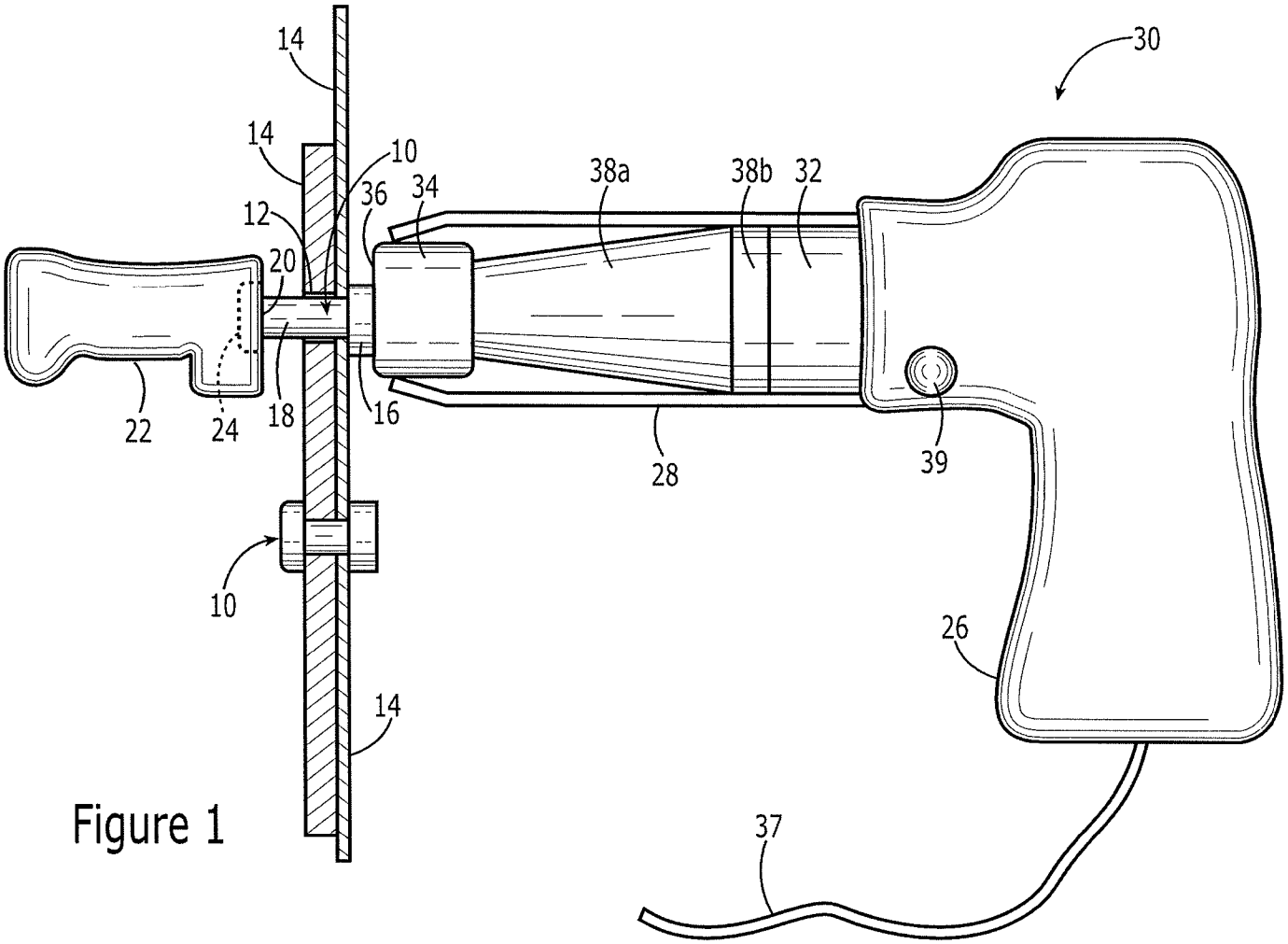
Figure 2:
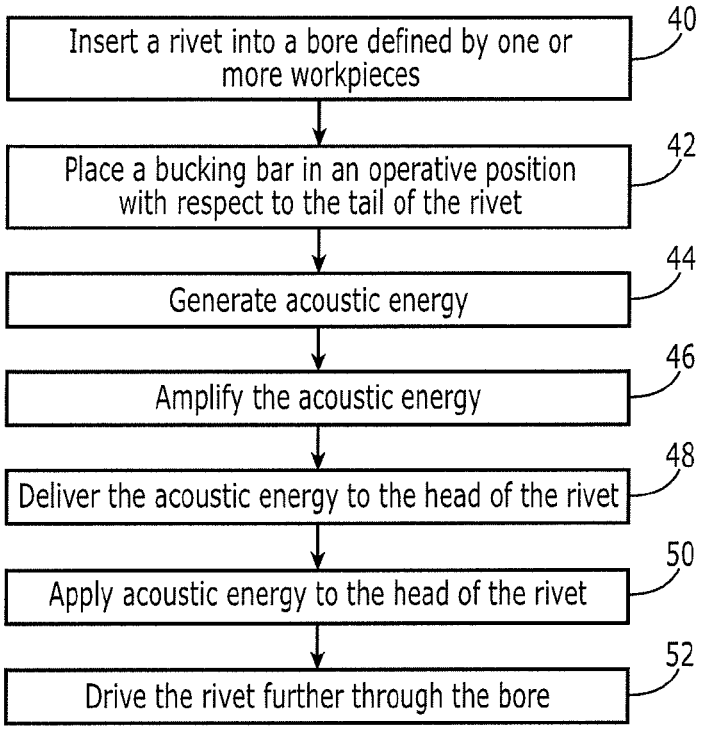
Figure 3:
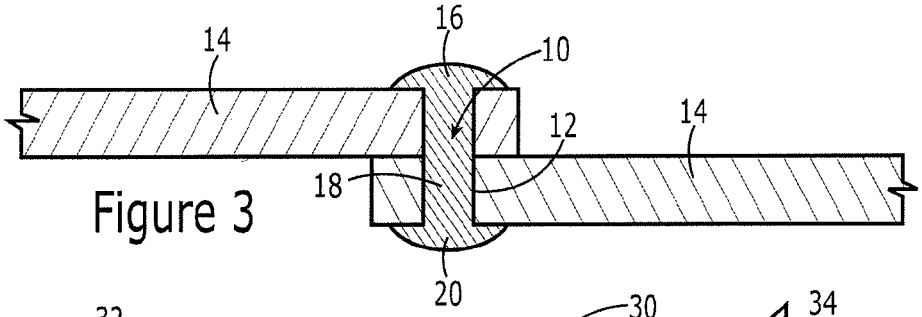
Figure 4:
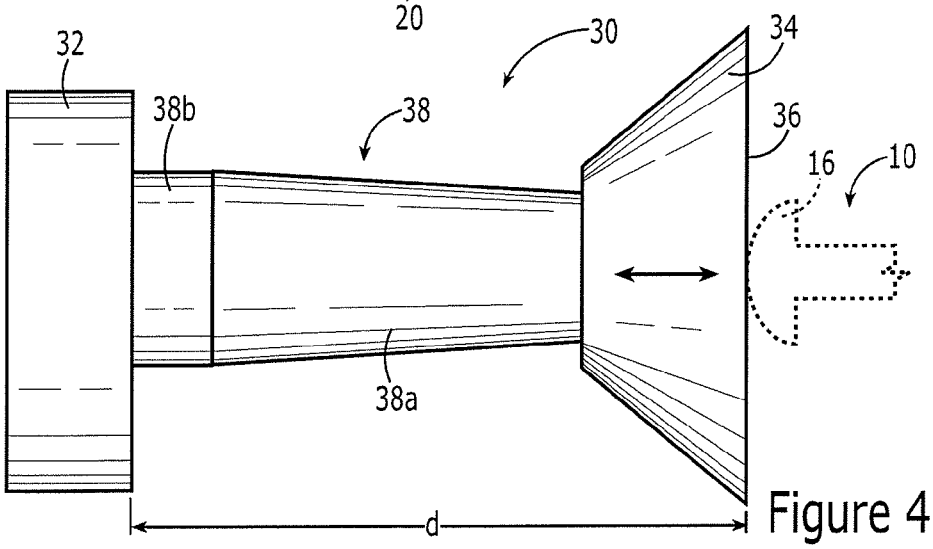
Figure 5:
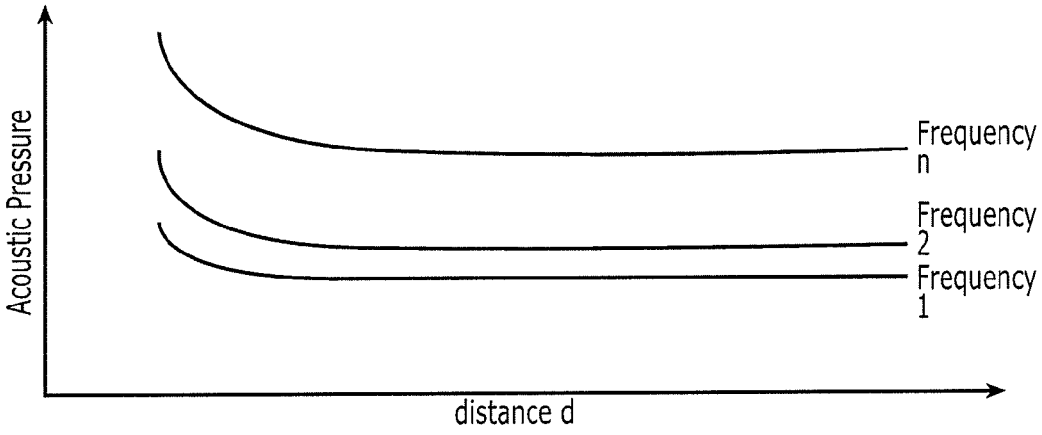

Having thus described certain example embodiments of the present disclosure in general terms, reference will hereinafter be made to the accompanying drawings, which are not necessarily drawn to scale, and wherein:

FIG. 1 is a plan view of an ultrasonic riveting system in operation with respect to the installation of a rivet in accordance with an example embodiment of the present disclosure;

FIG. 2 is a flowchart illustrating operations performed in order to install a rivet in accordance with an example embodiment of the present disclosure;

FIG. 3 is a cross-sectional side view of a rivet following installation;

FIG. 4 is a schematic representation of an ultrasonic riveting tool in accordance with an example embodiment of the present disclosure; and FIG. 5 is a graphical representation of the acoustic pressure that may be generated by ultrasonic energy at different frequencies and at different distances relative to the head of a rivet.

DETAILED DESCRIPTION

The aspects of the disclosure now will be described more fully hereinafter with reference to the accompanying drawings, in which some, but not all examples are shown. Indeed, this disclosure may be embodied in many different forms and should not be construed as limited to the examples set forth herein; rather, these examples are provided so that this disclosure will satisfy applicable legal requirements. Like numbers refer to like elements throughout.

An ultrasonic riveting system and an associated method of installing a rivet are provided in accordance with an embodiment of the present disclosure. The ultrasonic riveting system and method may install a variety of different types of rivets, such as metal rivets having a head and a shank extending therefrom, for any of various different purposes, such as during the fabrication of a vehicle, a building or other structure. Once installed, the rivet generally secures or joins two or more workpieces. Although the workpieces may be formed of various metallic materials, the workpieces may be alternatively formed of any of a wide variety of other materials.

As shown in FIG. 1 and in block 40 of FIG. 2, a rivet is 10 initially inserted into a bore 12 defined by one or more workpieces 14. The bore may extend through the one or more workpieces. In the example depicted in FIG. 1, for example, each of the two workpieces may define a bore with the bores of the respective workpieces being aligned. As shown, the rivet initially includes a head 16 and a shank 18 that extends therefrom to an opposed tail 20. In the illustrated embodiment, the head of the rivet is shown to be cylindrical. However, the head may have various configurations including rounded configurations, but is generally larger, in diameter or cross-sectional size, than both the shank and the bore into which the rivet is inserted. In addition to preventing the head from being inserted within the bore, the size of the head also facilitates the application of an impact force, as discussed below, to the rivet.

As also shown in FIG. 1, the rivet 10 may be inserted through a first end of the bore 12 so as to extend partially therethrough such that the tail 20 of the rivet extends beyond the workpieces 14 on the opposite side of the workpieces from the head of the rivet. Alternatively, the rivet may be inserted such that the tail of the rivet is positioned within the bore defined by the workpieces. Still further, the rivet may be inserted into the bore by positioning the tail of the rivet proximate the first end of the bore with the remainder of the rivet extending outwardly therefrom such that a subsequent application of the impact force, as described below, causes the rivet to be further inserted through the bore.

As also shown in FIG. 1 and in block 42 of FIG. 2, a bucking bar 22 is placed in an operative position with respect to the tail 20 of the rivet 10. A bucking bar is generally formed of a material, such as a metal, having greater strength than the material that forms the rivet. For example, a bucking bar may be formed of a high strength steel, an alloyed steel or other material having a high impact strength. By being placed in an operative position with respect to the tail of the rivet, the bucking bar is positioned so as to make operative contact with the tail of the rivet during the installation of the rivet. In this regard, the bucking bar is generally positioned in alignment with the bore 12 defined by the one or more workpieces 14. Further, the bucking bar is generally placed on the opposite side of the workpieces from the head 16 of the rivet so as to make operative contact with the tail of the rivet as the rivet is driven further through the bore during the installation procedure.

Although the bucking bar 22 may define a relatively flat or planer surface, the bucking bar may define a recess 24 in alignment with the bore 12. The bucking bar may be positioned such that the tail 20 of the rivet 10 is configured to make operative contact within the recess defined by the bucking bar upon installation of the rivet. The recess defined by the bucking bar may have a size and a shape that is consistent with the size and shape into which the tail of the rivet is to be deformed during the installation procedure. Thus, the installation of the rivet may cause the tail to deform and to have the size and shape defined by the recess of the bucking bar.

As shown in block 50 of FIG. 2, acoustic energy may be applied to the head 16 of the rivet 10 to cause interaction between the rivet and the bucking bar 22 such that the tail 20 of the rivet is deformed. In this regard, the application of acoustic energy to the head of the rivet will deliver an impact force to the head of the rivet that may cause the rivet to be forced further through the bore 12 defined by the one or more workpieces with the travel of the rivet through the bore limited by contact of the head of the rivet with a respective one of the workpieces. Since the rivet is generally slightly longer than the bore defined by the one or more workpieces, the tail is driven beyond the workpieces and into operative contact with the bucking bar. The operative contact with the bucking bar causes the tail to be deformed and, in one embodiment, a rivet button is formed. The rivet button may have a larger size than the bore defined by the one or more workpieces such that the one or more workpieces are security held between the head of the rivet and the deformed tail of the rivet, as shown by the previously formed rivet in FIG. 1 and in more detail in FIG. 3. In an embodiment in which the bucking bar defines a recess 24 that is aligned with the bore defined by the one or more workpieces, the acoustic energy may deliver an impact force to the head of the rivet that causes the tail of the rivet to be forced into the recess defined by the bucking bar and to make operative contact with the bucking bar therewithin such that the tail of the rivet is deformed so as to have a size and shape defined by the recess of the bucking bar.

The acoustic energy may be generated and applied in various manners in order to install the rivet 10. In one embodiment, however, an ultrasonic riveting tool 30 is provided as shown in FIGS. 1 and 4 for applying the acoustic energy to the head 16 of the rivet. The ultrasonic riveting tool includes an ultrasonic transducer 32 configured to generate the acoustic energy. The ultrasonic riveting tool may include various types of ultrasonic transducers including a piezoelectric transducer formed of a piezoelectric ceramic material, such as lead zirconate titanate (PZT). For example, the ultrasonic transducer may be formed of a piezoelectric stack. The ultrasonic transducer generates an acoustic signal in the form of an oscillating longitudinal wave. Although the ultrasonic transducer may be configured to generate acoustic signals having various frequencies, the ultrasonic transducer of one embodiment generates acoustic signals having a frequency above the frequency limit of human hearing, such as a frequency of 20 kHz or above. In some embodiments, the ultrasonic transducer may generate acoustic signals having signals substantially above the frequency limit of human hearing, such as frequencies up to or above 100 kHz.

By way of example, the ultrasonic transducer 32 may be configured to generate acoustic signals having an initial ultrasonic wave propagation velocity Ci that is defined as $Ci=\lambda i fi$ wherein $\lambda i$ is the wavelength and fi is the frequency of the acoustic signals. Additionally, for a longitudinal wave, the acoustic pressure Po of the acoustic signals can be expressed as $Po=VZ$ wherein V is the transmitting velocity and Z is the characteristic impedance. In this regard, the characteristic impedance may be defined as $Z=\rho C$ wherein $\rho$ is the density of the transmitting medium and C is the speed of sound in the medium. In an instance in which the transmitting velocity is equal to the speed of sound, the acoustic pressure can be redefined as $Po=CZ=\rho C^2=\rho(\lambda f)^2$ in terms of wavelength A and frequency f, in the medium wherein f=fi.

As also shown in FIGS. 1 and 4, the ultrasonic riveting tool 30 also includes an acoustic anvil 34 proximate the head 16 of the rivet 10. The acoustic anvil is configured to receive the acoustic energy from the ultrasonic transducer 32 and to deliver the acoustic energy to the head of the rivet. The delivery of the acoustic energy to the head of the rivet delivers an impact force, such as an oscillating force, to the head of the rivet that causes the rivet to be installed. In particular, the delivery of the acoustic energy to the head of the rivet and the application of the corresponding impact force to the head of the rivet causes interaction between the rivet and the bucking bar 22 such that the tail 20 of the rivet is deformed. In this regard, the impact force that is delivered to the head of the rivet as a result of the acoustic energy drives the rivet through the bore such that the tail of the rivet operatively contacts the bucking bar and is deformed as described above.

The acoustic anvil 34 may include a contact surface 36 that is positioned proximate the head 16 of the rivet 10. In one embodiment shown in FIGS. 1 and 4, the contact surface of the acoustic anvil is configured to be placed in contact with the head of the rivet so as to facilitate the delivery of acoustic energy and correspondingly, the impact force thereto. While the contact surface of the acoustic anvil may be planer, the contact surface of the acoustic anvil may define a recess for at least partially receiving the head of the rivet. In one embodiment, for example, the recess may be defined to have a size and shape that matches the size and shape of the head of the rivet such that the head of the rivet may be snugly received within the recess defined by the contact surface of the acoustic anvil. The acoustic anvil may be formed of various materials, including relatively strong materials capable of withstanding the repeated delivery of the acoustic energy and the corresponding impact force to the heads of rivets. As such, the acoustic anvil may be formed of a high strength steel, such as 4340 alloyed steel, in one embodiment. Although the acoustic anvil may have a cylindrical or other shape, the acoustic anvil of one embodiment has a frustoconical shape as shown in FIGS. 1 and 4.

As also shown in FIGS. 1 and 4, the ultrasonic riveting tool 30 may also include a tool body 38 positioned between the ultrasonic transducer 32 and the acoustic anvil 34. The tool body may include a horn **38*a* that is configured to direct the acoustic energy generated by the ultrasonic transducer to the acoustic anvil. In one embodiment, the tool body may optionally include a booster or amplitude modifier 38*b* that is configured to amplify the acoustic energy as the acoustic energy is directed from the ultrasonic transducer to the acoustic anvil. The booster may be configured to modify the amplitude of the acoustic pressure Po, although the acoustic pressure Po will remain dependent upon the frequency of the acoustic signals generated by the acoustic transducer 32**.

The booster **38*b* of one embodiment may be a one-half-wavelength long resonant section made of aluminum or titanium, such as 7050 aluminum or Ti-6Al-4V titanium. The booster may be mounted between the ultrasonic transducer 32 and the horn 38*a***, and may modify the amplitude of vibration applied to the horn. To provide the amplitude change, the booster may have different diameters and masses on either side of its center section. In general, an amplitude increasing booster has a smaller mass at the end attached to the horn, while an amplitude decreasing booster has a greater mass at the end attached to the horn.

The horn **38*a* may be formed of a solid piece of material, such as high strength aluminum, titanium or stainless steel, such as 7050 aluminum, Ti-6Al-4V titanium, 4340 alloyed steel or 440C stainless steel. The solid horn of one embodiment is formed of a tapering metal bar with variable-shaped longitudinal cross-section areas that could be stepped, exponential, conical, or catenoidal. The horn may amplify the oscillation displacement amplitude provided by the ultrasonic transducer 32. The horn may also be used in conjunction with the booster 38*b* to further modify the amplitude of the acoustic waves. The horn is configured to transmit the acoustic signals in the form of mechanical vibration to the acoustic anvil 34. In this regard, when an acoustic signal passes from one medium, such as the booster, to another medium, such as the horn, the frequency of the acoustic signal remains constant, but the velocity changes depending upon the materials that form the mediums. As such, while traveling in the horn, the wavelength $\lambda h$ of the acoustic signals will change in accordance with $\lambda h=Ch/fi$ wherein Ch is the speed of sound in the horn. In an embodiment in which the horn is formed of steel, the longitudinal wave velocity Ch in the horn is defined as: $Ch=\sqrt{[\{Es(1-Rs)\}/\{\rho s(1+Rs)(1-2Rs)\}]}$ wherein Es is the Young's modulus, Rs is the Poisson's ratio and $\rho s$ is the density of the steel material. As such, the vibration pressure amplitude of the horn Ph may be expressed by an attenuation function approximately as $Ph=Po\{\exp(-\mu d)\}$ wherein $\mu$ is the attenuation factor and d is the distance from the ultrasonic transducer 32 to the head 16 of the rivet 10, as described below. Thus, the acoustic pressure delivered by the horn to the acoustic anvil and, in turn, to the head of the rivet is dependent upon the distance d and the frequency fi of the acoustic signal as shown in FIG. 5** and discussed below.

Additionally, the horn 38*a* may structurally support the ultrasonic riveting tool 30. The horn may have various shapes such as a conical shape, a stepped shape, an exponential shape or the like. The horn may be attached, such as by threadable attachment, to the acoustic anvil 34 such that the acoustic signals propagate from the horn to the acoustic anvil. To complete the assembly of components, the ultrasonic transducer 32 may be attached to the booster 38*b* by using mechanical fasteners, such as screws or bolts, and similarly the booster and the horn may be connected with mechanical fasteners, such as screws or bolts. In this regard, in response to the acoustic pressure delivered by the horn, the acoustic anvil may generate an estimated riveting force F of $F=PhA$ wherein A is the contact area between the acoustic anvil and the head of the rivet. Additionally, the approximate displacement amplitude of the acoustic anvil may be expressed as $Aa \approx Ph/(2\pi fi\rho sCh)$.

By utilizing an ultrasonic riveting tool 30, acoustic energy may be generated, such as by the ultrasonic transducer 32, and may be delivered to the head 16 of the rivet 10, such as by propagation through the horn 38*a* and/or the acoustic anvil 34. See blocks 44 and 48 of FIG. 2. In one embodiment, the acoustic energy may be amplified following generation of the acoustic energy and prior to delivery of the acoustic energy to the head of the rivet, such as by the booster as described above. See block 46 of FIG. 2. By applying acoustic energy to the head of the rivet, the rivet may be driven further through the bore 12 as shown in block 52 of FIG. 2 so as to force the tail 20 of the rivet into operative contact with the bucking bar 22, thereby deforming the tail of the rivet and completing the installation of the rivet.

The ultrasonic riveting tool 30 may also include a grip handle 26 and a guard casing 28. The grip handle is structurally attached to the ultrasonic transducer 32, by threads for example, such that the ultrasonic transducer, the tool body 38 and the acoustic anvil 34 extend outwardly therefrom. The grip handle may be configured to be comfortably gripped by the operator during the installation of a rivet. The guard casing may be attached to and may extend outwardly from the grip handle. The guard casing may have a cylindrical shape and may house the ultrasonic transducer, the tool body and at least a portion of the acoustic anvil as shown in FIG. 1. In order to activate the acoustic transducer, an alternating current (A/C) electrical power input 37 may be provided and the ultrasonic riveting tool, such as the grip handle, may include a switch 39 to permit the operator to selectively apply electrical current to the acoustic transducer upon actuation of the switch, thereby causing the acoustic transducer to generate acoustic signals.

It may be desirable to alter the impact force to be delivered to the head 16 of the rivet 10 for various reasons. For example, it may be desirable to deliver different amounts of impact force to the head of the rivet depending upon the type or size of rivet to be installed. In this regard, larger rivets may require increased impact force to be delivered to the head of the rivet relative to smaller rivets in order to install the rivet. Thus, the ultrasonic riveting tool 30 and associated method of an example embodiment of the present disclosure permit the acoustic energy that is delivered to the head of the rivet to be tailored depending upon the circumstances including the size of the rivet.

The impact force that is delivered to the head 16 of the rivet 10 corresponds to the acoustic pressure that is delivered to the head of the rivet. In this regard, acoustic energy having increased acoustic pressure correspondingly delivers a greater impact force to the head of the rivet, while acoustic energy having a lower acoustic pressure correspondingly delivers a smaller impact force to the head of the rivet. As shown in FIG. 5 and as described above, the acoustic pressure may depend upon the frequency of the acoustic energy and the distance d defined between the ultrasonic transducer 32 and the head of the rivet as depicted by distance d in FIG. 4 in an instance in which the contact surface 36 of the acoustic anvil 34 is to be in contact with the head of the rivet. Thus, the application of acoustic energy to the head of the rivet may include establishing in impact force to be delivered to the head of the rivet based upon the frequency of the acoustic energy. In this regard, the ultrasonic transducer can be selected or otherwise configured to generate acoustic energy having a predetermined frequency that corresponds to an acoustic pressure that will create a desired amount of impact force to be delivered to the head of the rivet. As such, the ultrasonic transducer may be configured to selectively provide acoustic energy having any one of a plurality of different frequencies such that impact force to be delivered to the head of the rivet is configurable based upon a frequency of the acoustic energy. In this regard, a single ultrasonic transducer may be configured to be driven so as to provide acoustic energy having any one of a plurality of different frequencies, which may be selected such that the desired amount of impact force is delivered to the head of the rivet. Alternatively, different ultrasonic transducers may be employed with the ultrasonic riveting tool 30 with each ultrasonic transducer configured to selectively provide acoustic energy having a different frequency with the ultrasonic transducer that is selected to provide the acoustic energy being configured to provide the acoustic energy at a frequency that corresponds to a desired amount of impact force being delivered to the head of the rivet.

Additionally or alternatively, the spacing between the ultrasonic transducer 32 and the head 16 of the rivet 10 may be selected, such as by adjusting the length of the tool body 38 such that the impact force to be delivered to the head of the rivet is configurable based upon the spacing between the ultrasonic transducer and the head of the rivet. As shown schematically in FIG. 5, for acoustic energy having a predefined frequency, for example, the distance between the ultrasonic transducer and the head of the rivet may be increased in order to reduce the acoustic pressure and correspondingly reduce the impact force to be delivered to the head of the rivet, while the distance may be decreased between the ultrasonic transducer and the head of the rivet in order to increase the acoustic pressure and correspondingly increase the impact force delivered to the head of the rivet.

The ultrasonic riveting tool 30 and associated method may be quieter, due to their reliance upon acoustic energy, than a riveting tool that relies upon compressed air to generate the impact force required for rivet installation. Additionally, the ultrasonic riveting tool and associated method of an example embodiment may smooth the vibrations that may otherwise be generated by a riveting tool that relies upon compressed air to install a rivet 10, thereby providing for an improved ergonomic experience for the operator. Further, reliance upon acoustic energy in order to create the impact force that causes a rivet to be installed permits the impact force to be accurately controlled. As such the impact forces delivered during rivet installation may be improved or optimized, such as during the installation of rivets having various sizes.

Many modifications of the various aspects of the disclosure set forth herein will become apparent to one skilled in the art to which this disclosure pertains, having the benefit of the teachings presented in the foregoing description and the associated drawings. Therefore, it is to be understood that the disclosure is not to be limited to the specific examples presented herein and that modifications and other embodiments are intended to be included within the scope of the appended claims. Although specific terms are employed herein, they are used in a generic and descriptive sense only and not for purposes of limitation.

What is claimed is:

1. A method installing a rivet, the method comprising:

inserting a rivet into a bore defined by one or more workpieces, wherein the rivet extends from a head to an opposed tail;

placing a bucking bar in an operative position with respect to the tail of the rivet;

generating acoustic energy with a source of acoustic energy that is spaced from the head of the rivet; and applying the acoustic energy to the head of the rivet, wherein applying acoustic energy comprises delivering an impact force to the head of the rivet as a result of application of the acoustic energy with the impact force attributable to the acoustic energy serving to drive the rivet through the bore and to force the tail of the rivet into operable contact with the bucking bar such that the tail of the rivet is deformed, wherein a length of a tool body is adjustable and contributes to the spacing of the source of the acoustic energy from the head of the rivet such that the impact force to be delivered to the head of the rivet is configurable based upon the spacing between the source of the acoustic energy and the head of the rivet.

2. A method according to claim 1 further comprising establishing the impact force to be delivered to the head of the rivet based upon a frequency of the acoustic energy.

3. A method according to claim 1 further comprising amplifying the acoustic energy following generation of the acoustic energy and prior to delivery of the acoustic energy to the head of the rivet.

4. An ultrasonic riveting tool comprising:

an ultrasonic transducer configured to generate acoustic energy;

an acoustic anvil proximate a head of a rivet, wherein the acoustic anvil is configured to receive the acoustic energy from the ultrasonic transducer and to deliver the acoustic energy to the head of the rivet, wherein the acoustic energy delivered by the acoustic anvil delivers an impact force to the head of the rivet that serves to drive the rivet through the bore and to force the tail of the rivet into operable contact with a bucking bar, located in an operative position with respect to a tail of the rivet, such that the tail of the rivet is deformed; and a tool body positioned between the ultrasonic transducer and the acoustic anvil, wherein the tool body is configured to direct the acoustic energy generated by the ultrasonic transducer to the acoustic anvil, wherein the tool body contributes to spacing the ultrasonic transducer from the head of the rivet such that the impact force to be delivered to the head of the rivet is configurable based upon the spacing between the ultrasonic transducer and the head of the rivet, and wherein a length of the tool body is adjustable in order to differently space the ultrasonic transducer from the head of the rivet such that the impact force to be delivered to the head of the rivet is correspondingly configured.

5. An ultrasonic riveting tool according to claim 4 wherein the ultrasonic transducer is configured to selectively provide acoustic energy having any one of a plurality of different frequencies such that an impact force to be delivered to the head of the rivet is configurable based upon the frequency of the acoustic energy.

6. An ultrasonic riveting tool according to claim 4 wherein the tool body comprises a horn configured to direct the acoustic energy generated by the ultrasonic transducer to the acoustic anvil.

7. An ultrasonic riveting tool according to claim 6 wherein the tool body comprises a booster configured to amplify the acoustic energy.

8. An ultrasonic riveting system according to claim 4 wherein the acoustic anvil has a frustoconical shape.

9. An ultrasonic riveting system according to claim 4 wherein the ultrasonic transducer, the tool body and the acoustic anvil are disposed in-line with the rivet.

10. An ultrasonic riveting system comprising:

a bucking bar configured to be placed in an operative position with respect to a tail of a rivet that extends through a bore defined by one or more workpieces;

an ultrasonic transducer configured to generate acoustic energy;

an acoustic anvil proximate a head of the rivet, wherein the acoustic anvil is configured to receive the acoustic energy from the ultrasonic transducer and to deliver the acoustic energy to the head of the rivet, wherein the acoustic energy delivered by the acoustic anvil delivers an impact force to the head of the rivet that serves to drive the rivet through the bore and to force the tail of the rivet into operable contact with the bucking bar such that the tail of the rivet is deformed; and a tool body positioned between the ultrasonic transducer and the acoustic anvil, wherein the tool body is configured to direct the acoustic energy generated by the ultrasonic transducer to the acoustic anvil;

wherein the tool body contributes to spacing the ultrasonic transducer from the head of the rivet such that said impact force to be delivered to the head of the rivet is configurable based upon the spacing between the ultrasonic transducer and the head of the rivet, and wherein a length of the tool body is adjustable in order to differently space the ultrasonic transducer from the head of the rivet such that the impact force to be delivered to the head of the rivet is correspondingly configured.

11. An ultrasonic riveting system according to claim 10 wherein the ultrasonic transducer is configured to selectively provide acoustic energy having any one of a plurality of different frequencies such that an impact force to be delivered to the head of the rivet is configurable based upon the frequency of the acoustic energy.

12. An ultrasonic riveting system according to claim 10 wherein the tool body comprises a horn configured to direct the acoustic energy generated by the ultrasonic transducer to the acoustic anvil.

13. An ultrasonic riveting system according to claim 12 wherein the tool body comprises a booster configured to amplify the acoustic energy.

14. An ultrasonic riveting system according to claim 10 wherein the ultrasonic transducer, the tool body and the acoustic anvil are disposed in-line with the rivet.

* * * * *